US005893224A

United States Patent [19]

Harrington et al.

[11] Patent Number: 5,893,224

[45] Date of Patent: Apr. 13, 1999

[54] CUTTING ARRANGEMENT FOR A SNOW BLOWER

[75] Inventors: Charles W. Harrington; Richard A. Heismann, both of Jackson, Tenn.

[73] Assignee: Murray, Inc., Brentwood, Tenn.

[21] Appl. No.: 08/922,535

[22] Filed: Sep. 3, 1997

[51] Int. Cl.[6] ..... E01H 5/09

[52] U.S. Cl. ..... 37/257; 37/254; 37/244; 37/465; 172/518

[58] Field of Search ..... 37/252, 254, 255, 37/257, 242, 244, 247, 248, 241, 465; 172/107, 119, 518, 554

[56] References Cited

U.S. PATENT DOCUMENTS

| | | | |
|---|---|---|---|
| 4,836,320 | 6/1989 | Sundin | 37/244 X |
| 5,101,585 | 4/1992 | Gerbrandt | 37/252 |
| 5,398,431 | 3/1995 | Beihoffer et al. | 37/254 X |
| 5,813,152 | 9/1998 | Weight | 37/254 X |

*Primary Examiner*—Victor Batson
*Attorney, Agent, or Firm*—Pillsbury Madison & Sutro LLP

[57] ABSTRACT

A snow blower is provided with cutting devices which are housed within, but project beyond, a housing provided for the blower's auger. As the cutting devices engage snow during the blower's advance, the cutting devices move in a direction which tends to urge the forward portion of the blower downwardly.

6 Claims, 1 Drawing Sheet

CUTTING ARRANGEMENT FOR A SNOW BLOWER

BACKGROUND OF THE INVENTION

1. Field of the Invention

The present invention relates to a snow blower provided with an arrangement for cutting compacted snow so as to facilitate operation of the blower's operation.

2. Prior Art

A problem experienced in operating a snow blower is that which occurs when the blower is advanced in a path through snow which has a crusted surface or which has been compacted. The dense, hard snow impedes penetration of the blower into the snow. One must repetitively drive the blower into the snow mass until forward progress stops, back the blower and then move it forward.

The problem of dealing with compacted snow has previously been addressed. For example, in U.S. Pat. No. 5,398,431 an arrangement is disclosed wherein a pair of plates are positioned outwardly of the ends of a housing which encloses the snow blower's auger. When the auger is driven, the plates rotate so as to break up crusted snow and ice and assist in propelling the snow blower forward.

Another example of a snow blower provided with cutting elements for compacted snow is disclosed in U.S. Pat. No. 5,101,585. This patent discloses an arrangement similar to that described with respect to U.S. Pat. No. 5,398,431. However, the corrugated cutting plates employed in U.S. Pat. No. 5,101,585 are mounted within the housing which encloses the auger.

SUMMARY OF THE INVENTION

The present invention overcomes deficiencies found in known devices. More particularly, according to the present invention, cutting members, in the form of toothed chains, are mounted within the auger's housing in such positions as to comply with ANSI standards concerning exposure of movable parts of a snow blower. Moreover, the cutting members are driven so as to move in a sense opposite that of the snow blower's auger. As the cutting members advance into the snow to be displaced by the blower, the cutting members move upwardly relative to the snow cover's surface. The upward motion of the chain cuts two paths through the crust allowing the side frame of the auger clearance to move forward. This action also tends to hold the forward portion of the snow blower down as it advances into the snow. By contrast, the direction of rotation of the cutting members in previously known snow blowers with such a feature rotate in the same direction as the auger. This tends to lift the forward portion of the snow blower when compacted snow is encountered thereby decreasing the operating efficiency of the blower.

BRIEF DESCRIPTION OF THE DRAWINGS

The invention now will be described in greater detail with respect to the accompanying drawings, wherein.

DETAILED DESCRIPTION OF PREFERRED EMBODIMENTS OF THE INVENTION

The present invention pertains to a feature incorporated in a conventional snow blower, a feature which can be described without completely describing the snow blower itself. Consequently, for convenience of illustration and description, a full snow blower is not illustrated in the accompanying drawings.

Figure 1:
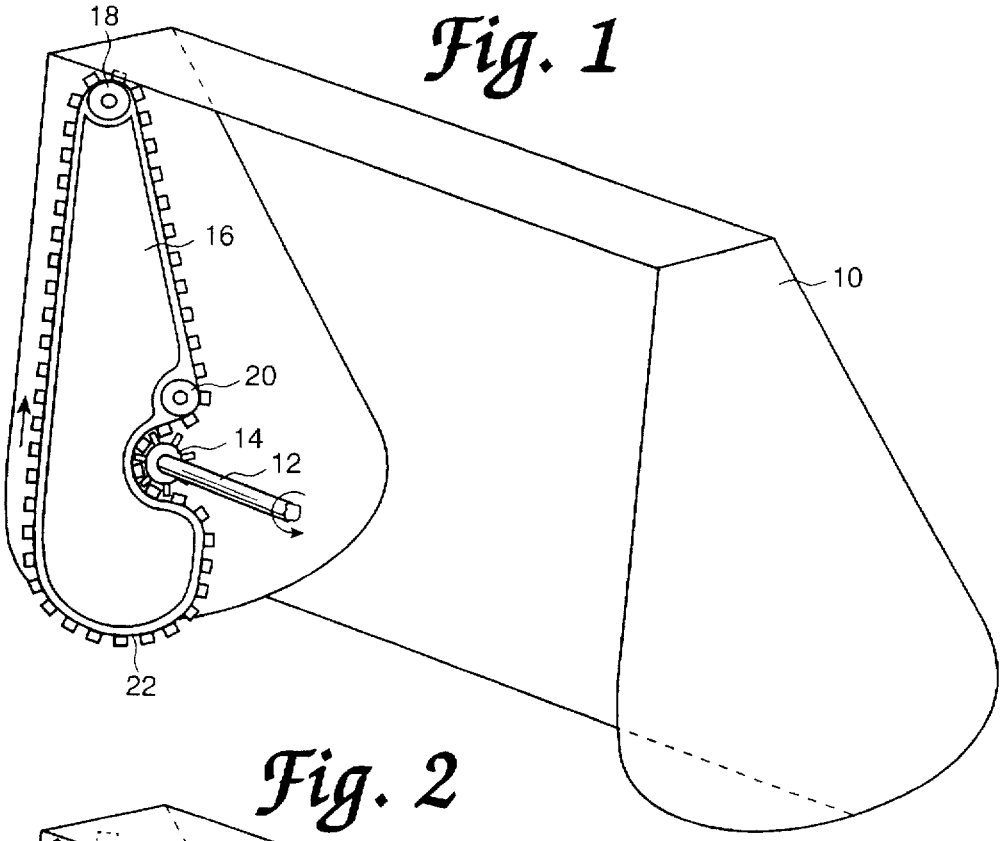
FIG. 1 is a perspective view which illustrates a first embodiment of an arrangement for mounting cutting elements within the auger housing of a snow blower.

Referring to FIG. 1, a first embodiment of the invention is shown. A conventional snow blower auger housing is designated as 10. An auger drive shaft is partially illustrated as 12. Shaft 12 extends substantially the entire length of the housing. Each end of the shaft is provided with a sprocket 14, only one of which is shown. As the auger is driven by shaft 12 in the counter-clockwise direction indicated by the arrow, sprocket 14 is similarly rotated.

A chain guide bar 16 is mounted at each end of the housing. Again, only one such guide bar is shown. The housing 10 supports two chain idlers 18 and 20 positioned adjacent the guide bar. A toothed chain 22 is guided by each guide bar 16. Each chain passes over idlers 18 and 20 and is directed around its sprocket 14, as indicated, whereby when shaft 12 is rotated in a counter-clockwise sense, chain 22 is moved in a clockwise direction about the guide bar 16.

The principal longitudinal axis of guide bar 16 is oriented in a vertical sense. Consequently, as each chain 22 moves relative to its guide bar, the teeth at the leading edge of the chain move upwardly. The guide bar 16 is so dimensioned, and is mounted to housing 10 in such a fashion, that the upwardly moving teeth of chain 22 project forwardly of the housing 10 by an amount not exceeding ANSI standards limiting the acceptable projection distance of a snow blower auger. The remainder of each chain is protected by the housing.

As the upwardly moving teeth of chain 22 engage compacted snow and/or a crusted snow surface, the resistance encountered tends to hold the forward portion of the snow blower down thereby contributing to the efficiency of the blower's advance into the snow which is being displaced by the blower. Additionally, the teeth cut through the compacted snow and crust which otherwise resists the advance of the snow blower. This permits the blower's auger to more efficiently move the snow to the snow blower's high speed impeller which displaces the snow via the blower's chute. If extremely solid areas of snow are encountered, the moving chains tend to lift and move them out of the way. Additionally, the close proximity of the chains and their supporting structure to the ends of the housing 10 assist in removing support for any crust on the snow.

When the crusted snow's resistance overcomes the traction of the snow blower's wheels, forward motion stops, and the cutting chains attack the crust. The augers chew up the cut snow, and it is discharged through the chute until such time as wheel traction is reestablished to move the snow blower forward.

Figure 2:
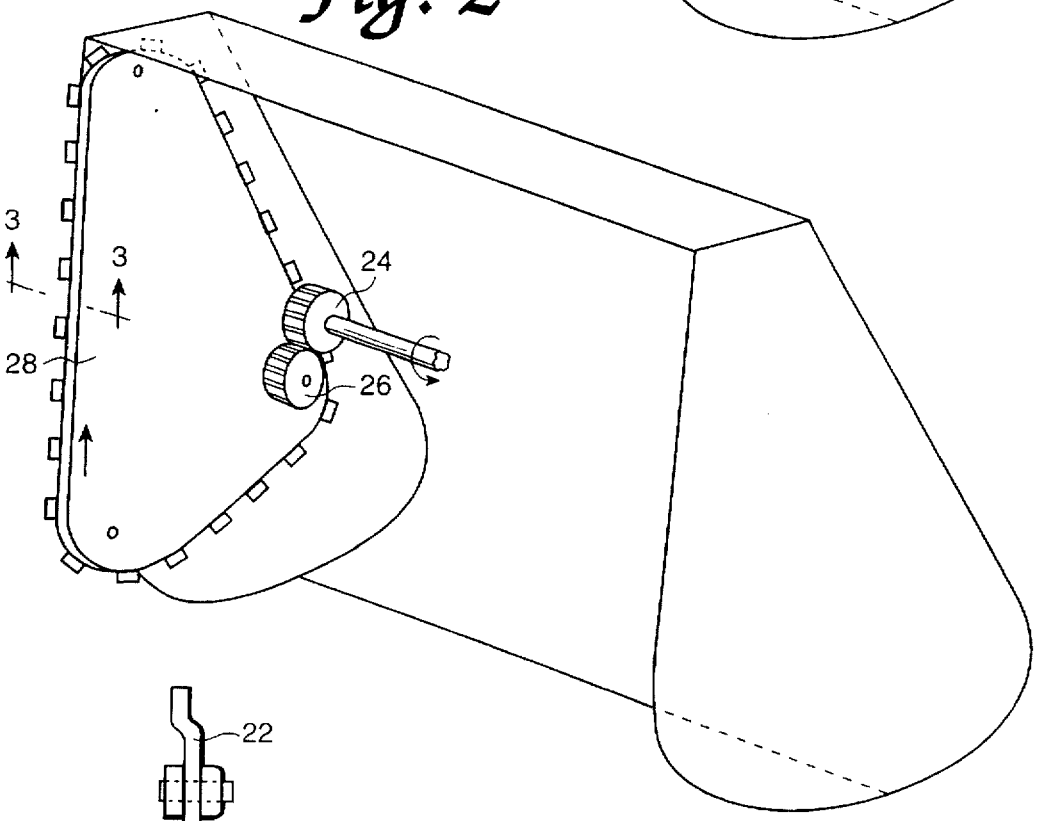
FIG. 2 illustrates a perspective view of a second embodiment of the invention.
Figure 3:
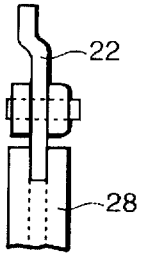
FIG. 3 is an enlarged sectional view of a portion of the embodiment shown in FIG. 2, taken along line 3—3 of FIG. 2.

FIG. 2 illustrates an alternative arrangement for supporting and driving the toothed chains 22. Instead of sprockets 14, each end of the shaft 12 is provided with a gear 24 which meshes with a gear 26 mounted on a generally triangular shaped chain guide bar 28. The bar 28 is a three piece lamination (FIG. 3). A sprocket (not shown) is provided between the outer layers of the lamination and is mounted on a shaft fixed to gear 26. The sprocket engages the teeth of chain 22 whereby when gear 26 is rotated, the chain moves about the guide bar 28. The chain is supported by bar 28 in conventional fashion, as also is illustrated in FIG. 3.

When gears 24 are rotated in counter-clockwise direction, as indicated by the arrow in FIG. 2, the respective chains at opposite ends of the housings are moved clockwise. Inasmuch as a major axis of the chain bar guide 28 is vertically oriented, the same results are achieved as described with reference to the embodiment illustrated in FIG. 1.

What is claimed is:

1. In a snow blower of the type having a driven auger partially enclosed within a housing having a first and second end, a cutting arrangement comprising:

an auger drive shaft for driving said auger;

chain bar guides mounted within the housing at said first and second ends;

a pair of cutting chains, each adapted to be supported by a respective chain bar guide such that a portion of each chain projects outwardly beyond said housing; and drive means interposed between the auger drive shaft and said cutting chains for moving said cutting chains in a direction opposite to a direction of movement of the auger drive shaft whereby the-portions of the. chains projecting outwardly beyond said housing move in an upward direction relative to the housing as said auger drive shaft is driven.

2. A cutting arrangement according to claim 1, wherein each of said chain bar guides has a substantially vertically extending major axis.

3. A cutting arrangement according to claim 1, wherein said drive means comprises a pair of sprockets joined to opposite ends of the auger drive shaft, said sprockets engaging respective ones of said pair of cutting chains to drive the cutting chains when the auger drive shaft is driven.

4. A cutting arrangement according to claim 3, wherein each of said chain bar guides has a substantially vertically extending major axis.

5. A cutting arrangement according to claim 1, wherein said drive means comprises a pair of gears joined to opposite ends of the auger drive shaft, said gears engaging respective additional gears joined to the chain bar guides, said additional gears driving sprockets on the chain bar guides which are engaged by respective ones of said pair of cutting chains.

6. A cutting arrangement according to claim 5, wherein each of said chain bar guides has a substantially vertically extending major axis.

* * * * *